US011536051B2

(12) United States Patent
Chen

(10) Patent No.: US 11,536,051 B2
(45) Date of Patent: Dec. 27, 2022

(54) ELECTRONIC CYLINDER LOCK

(71) Applicant: POWERTEK HARDWARE CO., LTD., Taichung (TW)

(72) Inventor: Chung-Yu Chen, Taichung (TW)

(73) Assignee: POWERTEK HARDWARE CO., LTD., Taichung (TW)

( * ) Notice: Subject to any disclaimer, the term of this patent is extended or adjusted under 35 U.S.C. 154(b) by 251 days.

(21) Appl. No.: 17/104,550

(22) Filed: Nov. 25, 2020

(65) Prior Publication Data

US 2021/0222462 A1 Jul. 22, 2021

(30) Foreign Application Priority Data

Jan. 22, 2020 (TW) ..... 109102374

(51) Int. Cl.
*E05B 47/06* (2006.01)
*E05B 15/00* (2006.01)
*E05B 47/00* (2006.01)

(52) U.S. Cl.
CPC ..... *E05B 47/068* (2013.01); *E05B 15/0033* (2013.01); *E05B 47/0603* (2013.01); *E05B 2047/0024* (2013.01)

(58) Field of Classification Search
CPC ..... E05B 47/00; E05B 47/06; E05B 47/0676; E05B 47/068; E05B 47/0684; E05B 47/0688; E05B 47/0692; E05B 47/0603; E05B 2047/0014; E05B 2047/0018; E05B 2047/0024; E05B 2047/0025; E05B 49/00; E05B 15/00; E05B 15/0033
USPC ..... 292/336.3
See application file for complete search history.

(56) References Cited

U.S. PATENT DOCUMENTS

2004/0040355 A1* 3/2004 Goldman ..... E05B 47/0642 70/277

FOREIGN PATENT DOCUMENTS

EP 0962610 A2 * 12/1999 ..... E05B 9/10
WO WO-2018156024 A1 * 8/2018 ..... E05B 13/005

* cited by examiner

*Primary Examiner* — Nathan Cumar
(74) *Attorney, Agent, or Firm* — Pai Patent & Trademark Law Firm; Chao-Chang David Pai

(57) ABSTRACT

An electronic cylinder lock has a main body. The main body is provided with a rotary cam. A first shaft is connected to the rotary cam. The first shaft has a first engaging portion. The main body is provided with a second shaft. The second shaft has a second engaging portion. A control lever is connected to the second shaft. A driving source is connected to the control lever. The driving source can drive the control lever to pull the second shaft to approach the first shaft, so that the second engaging portion is engaged with the first engaging portion, thereby improving the joint stability between the second engaging portion and the first engaging portion.

10 Claims, 7 Drawing Sheets

ELECTRONIC CYLINDER LOCK

FIELD OF THE INVENTION

The present invention relates to an electronic cylinder lock.

BACKGROUND OF THE INVENTION

A conventional cylinder lock mainly has a main body. The main body is provided with a rotary cam. Two opposite sides of the main body are provided with an inner knob and an outer knob, respectively. The inner knob is connected to the rotary cam. The outer knob is connected to the rotary cam through an engaging mechanism. The engaging mechanism generally has a first engaging member disposed on the rotary cam, a second engaging member disposed on the outer knob, and a driving member that can drive the first engaging member to engage with or disengage from the second engaging portion. Therefore, when the cylinder lock is in a locked state, the driving member drives the first engaging member to disengage from the second engaging member, so that the outer knob is idling and cannot drive the rotary cam to perform unlocking. When the cylinder lock is in an unlocked state, the driving member drives the first engaging member to engage with the second engaging member, so that the outer knob can drive the rotary cam to perform unlocking.

However, the aforementioned cylinder lock has the following disadvantages. Firstly, the driving member uses a pushing means to push the first engaging member toward the second engaging member, so that the first engaging member is engaged with the second engaging member. Therefore, the second engaging member has a tendency to be pushed away from the first engaging member, resulting in that the first engaging member cannot be reliably engaged with the second engaging member, that is, the engagement is incomplete or the first engaging member is not engaged with the second engaging member, so that the outer knob cannot drive the rotary cam to perform unlocking. Secondly, because the driving member is disposed in the main body, the driving member is limited by the space of the main body. Only a smaller motor can be used, resulting in insufficient output of the driving member, and the first engaging member cannot be effectively driven. Thirdly, a control module disposed in the first knob and a read head disposed in the second knob will be blocked by the driving member disposed in the main body, which is inconvenient for power connection and signal connection between the two. Accordingly, the inventor of the present invention has devoted himself based on his many years of practical experiences to solve these problems.

SUMMARY OF THE INVENTION

The primary object of the present invention is to provide an electronic cylinder lock, which uses a pulling means to perform locking and unlocking, thereby improving the joint stability of an engaging mechanism.

In order to achieve the aforesaid object, the present invention provides an electronic cylinder lock comprising a main body. The main body has a shaft hole and a notch communicating with the shaft hole. A rotary cam is rotatably disposed in the notch. A first shaft and a second shaft are insertedly connected to two ends of the shaft hole of the main body. One end of the first shaft, inserted into the shaft hole, is provided with a first engaging portion. Another end of the first shaft is provided with a first coupling portion. The first shaft has an axial first through hole therein. The first through hole passes through the first engaging portion and the first coupling portion. One end of the second shaft, inserted into the shaft hole, is provided with a second engaging portion. Another end of the first shaft is provided with a second coupling portion. A control lever is inserted in the first through hole. One end of the control lever is connected to the second shaft. Another end of the control lever is provided with a driving portion. A first knob is connected to the first coupling portion. A second knob is connected to the second coupling portion. The electronic cylinder lock further comprises a control unit. The control unit has a driving source accommodated in the first knob. The driving source is connected to the driving portion for driving the control lever to link the second shaft to slide axially relative to the shaft hole, so that the second engaging portion is selectively disengaged from or engaged with the first engaging portion.

In the electronic cylinder lock provided by the present invention, the driving member adopts a pulling means, and the second shaft is pulled toward the first shaft through the control lever, so that the second engaging portion is engaged with the first engaging portion. Therefore, the second engaging portion has a tendency to approach the first engaging portion, which can ensure that the second engaging portion is indeed engaged with the first engaging portion to improve the stability of the engagement.

DETAILED DESCRIPTION OF THE PREFERRED EMBODIMENTS

Embodiments of the present invention will now be described, by way of example only, with reference to the accompanying drawings.

Figure 1:
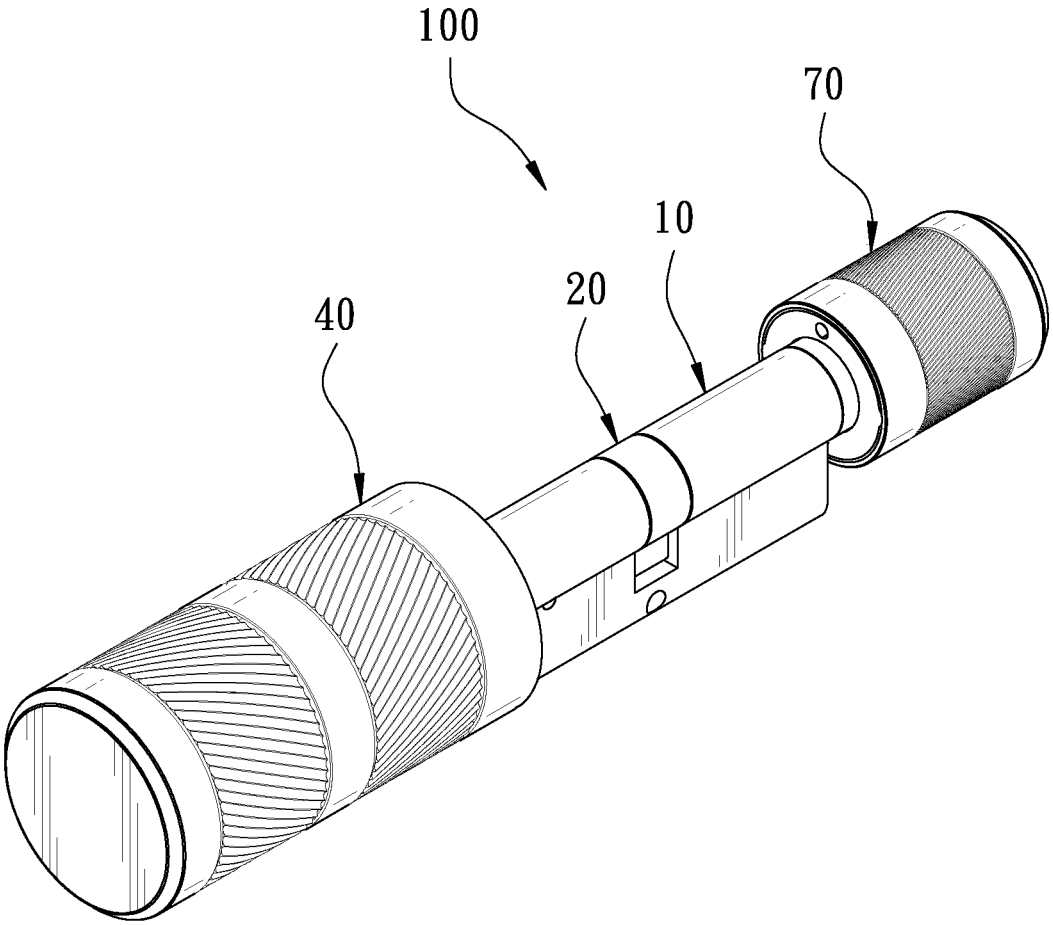
FIG. 1 is a perspective view according to a preferred embodiment of the present invention.
Figure 2:
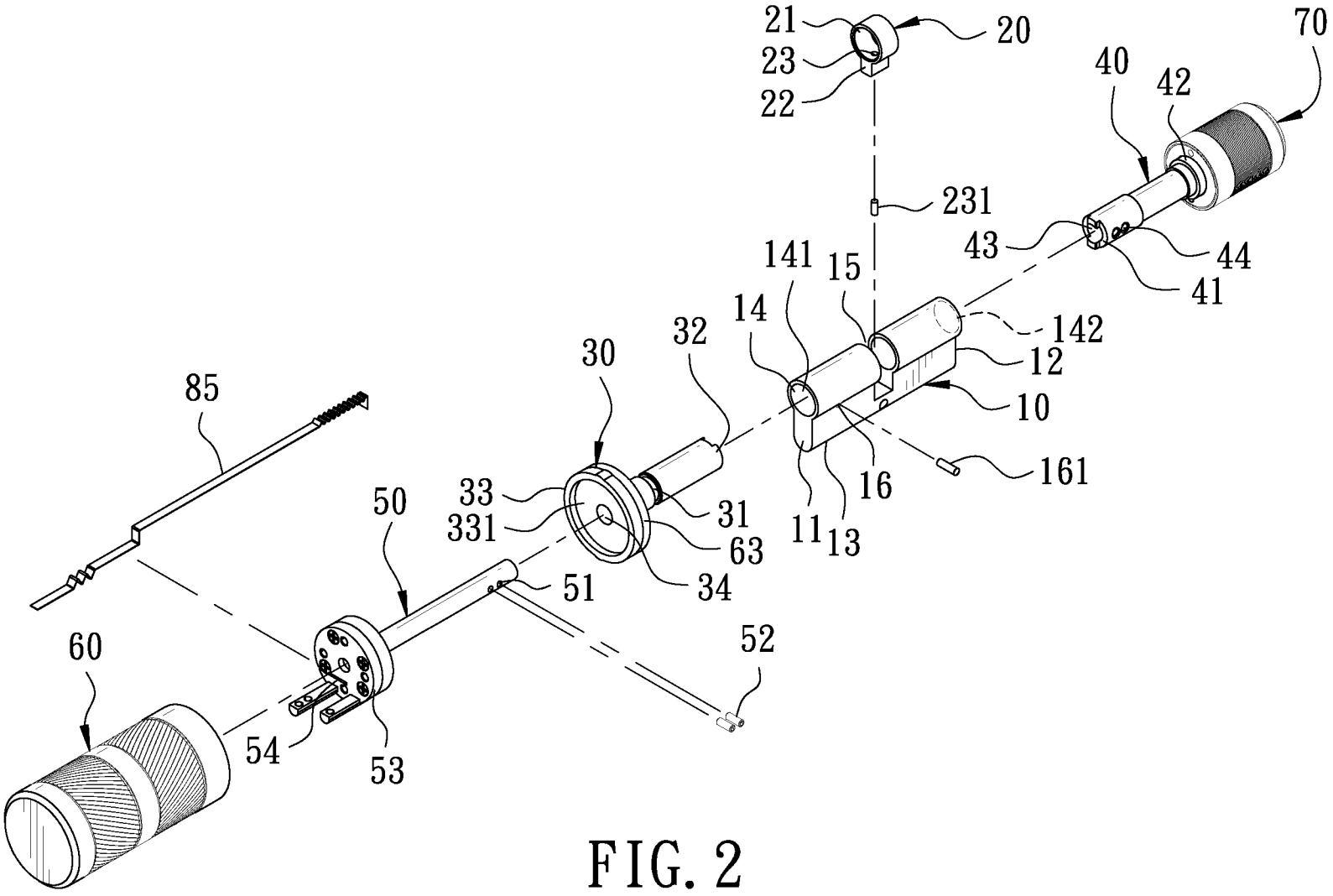
FIG. 2 is an exploded view according to the preferred embodiment of the present invention.
Figure 3:
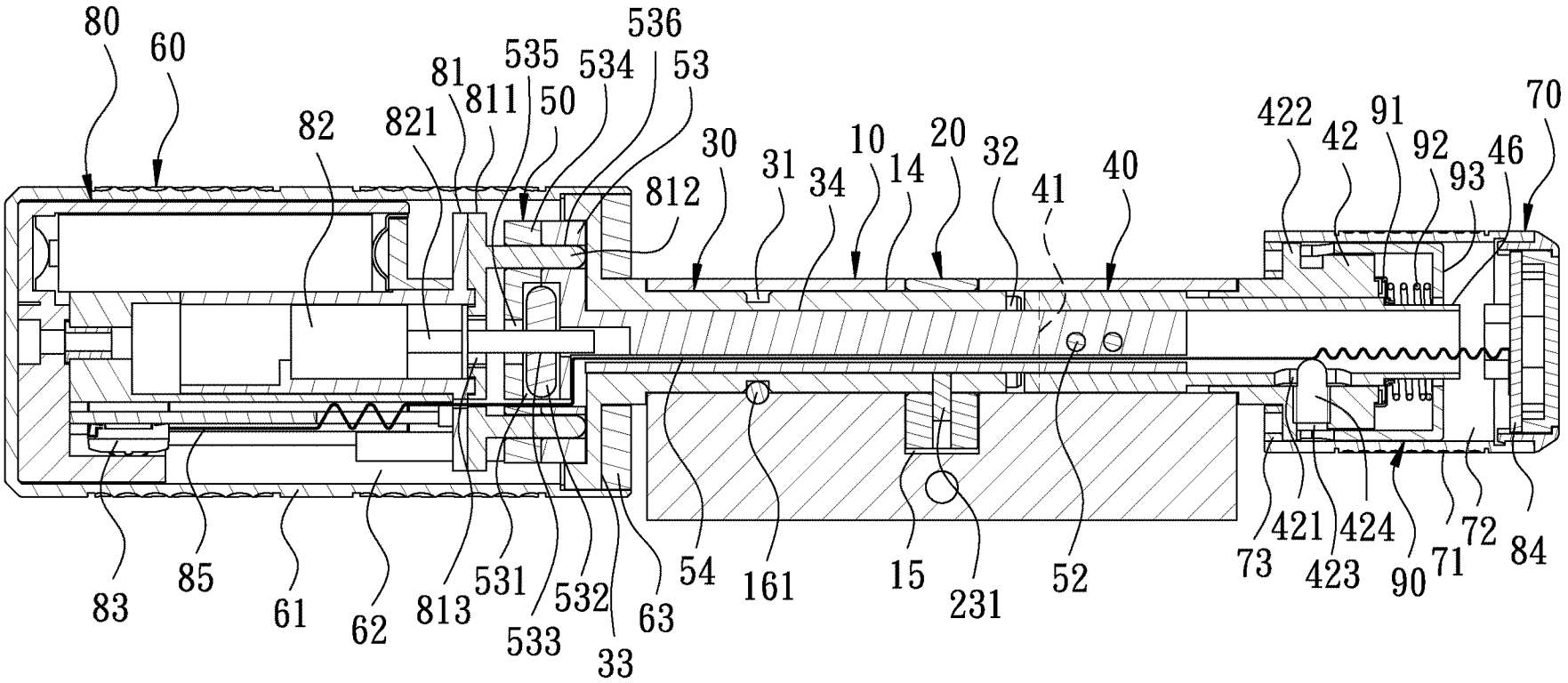
FIG. 3 is a cross-sectional view according to the preferred embodiment of the present invention.

FIG. 1 is a perspective view according to a preferred embodiment of the present invention. FIG. 2 is an exploded view according to the preferred embodiment of the present invention. FIG. 3 is a cross-sectional view according to the preferred embodiment of the present invention. The present invention discloses an electronic cylinder lock 100, comprising a main body 10, a rotary cam 20, a first shaft 30, a second shaft 40, a control lever 50, a first knob 60, a second knob 70, and a control unit 80.

The main body 10 has a first side 11, a second side 12 opposite to the first side 11, and a circumferential side 13 connected between the first side 11 and the second side 12. The main body 10 has a shaft hole 14 passing through the first side 11 and the second side 12. The first side 11 is formed with a corresponding first opening 141, and the second side 12 is formed with a corresponding second opening 142. The circumferential side 13 of the main body 10 is formed with a notch 15 communicating with the shaft hole 14 and a limiting hole 16 communicating with the shaft hole 14. A limiting pin 161 is provided in the limiting hole 16.

The rotary cam 20 is accommodated in the notch 15. The rotary cam 20 has a connecting hole 21 corresponding to the shaft hole 14. The circumferential side of the rotary cam 20 is provided with a raised portion 22. The raised portion 22 has a fixing hole 23 communicating with the connecting hole 21. A fixing pin 231 is provided in the fixing hole 23.

The first shaft 30 is inserted in the shaft hole 14 from the first opening 141. The outer wall of the first shaft 30 is formed with an annular limiting groove 31 corresponding to the limiting pin 161. The limiting pin 161 is confined in the annular limiting groove 31, so that the first shaft 30 can only rotate relative to the shaft hole 14. One end of the first shaft 30 is inserted into the shaft hole 14 and the connecting hole 21 of the rotary cam 20 and is provided with a first engaging portion 32. One end of the fixing pin 231 is inserted into the connecting hole 21 and is pressed against the outer wall of the first shaft 30, so that the first shaft 30 is connected to the rotary cam 20, and the first shaft 30 can drive the rotary cam 20 to rotate. The other end of the first shaft 30 is provided with a first coupling portion 33. The outer side of the first coupling portion 33 is recessed to form a rotation trough 331. The first shaft 30 has an axial first through hole 34 therein. The first through hole 34 passes through the first engaging portion 32 and the first coupling portion 33.

The second shaft 40 is inserted in the shaft hole 14 from the second opening 142 and can rotate and slide axially relative to the shaft hole 14. One end of the second shaft 40, inserted into the shaft hole 14, is provided with a second engaging portion 41 corresponding to the first engaging portion 32. The second engaging portion 41 is engagable with the first engaging portion 32, so that the second shaft 40 can drive the first shaft 30 to rotate. In this embodiment, the first engaging portion 32 is composed of a plurality of spaced protrusions, and the second engaging portion 41 is composed of a plurality of spaced notches. The other end of the first shaft 40 is provided with a second coupling portion 42. The second shaft 40 has an axial second through hole 43 therein. The second through hole 43 passes through the second engaging portion 41 and the second coupling portion 42. Furthermore, the outer wall of the second shaft 40 is formed with at least one first perforation 44 communicating with the second through hole 43.

The control lever 50 is inserted in the first through hole 34 of the first shaft 30 and can slide axially relative to the first shaft 30. One end of the control lever 50 is inserted through the first engaging portion 32 into the second through hole 43, and is formed with at least one second perforation 51 corresponding to the first perforation 44, and is provided with at least one connecting pin 52. The connecting pin 52 is inserted through the corresponding first perforation 44 and the corresponding second perforation 51, so that the control lever 50 is connected to the second shaft 40 and can drive the second shaft 40 to slide axially relative to the shaft hole 14. In addition, the other end of the control lever 50 is provided with a driving portion 53. The driving portion 53 is rotatably accommodated in the rotation trough 331. The outer wall of the control lever 50 is provided with an axial slot 54.

The first knob 60 is connected to the first coupling portion 33 and configured to drive the first shaft 30 to rotate relative to the shaft hole 14. The first knob 60 has a first housing 61. A first accommodating space 62 is defined in the first housing 61 for accommodating the first coupling portion 33. The opening of the first accommodating space 62 is sealed by a first cover 63, so that the first knob 60 is connected to the first coupling portion 33.

The second knob 70 is connected to the second coupling portion 42 and configured to drive the second shaft 50 to rotate relative to the shaft hole 14. The second knob 70 has a second housing 71. A second accommodating space 72 is defined in the second housing 71 for accommodating the second coupling portion 42. The opening of the second accommodating space 72 is sealed by a second cover 73, so that the second knob 70 is connected to the second coupling portion 42.

The control unit 80 has a driving base 81 accommodated in the first accommodating space 62. A driving source 82, such as a motor, is mounted on the driving base 81. The driving source 82 is connected to the driving portion 53 of the control lever 50 for driving the control lever 50 to slide axially relative to the first shaft 30. The control unit 80 further has a control assembly 83 such as a circuit board and a power supply, and a read head 84 disposed in the second accommodating space 72, and at least one lead wire 85. One end of the lead wire 85 is connected to the control assembly 83, and the other end of the lead wire 85 is inserted through the slot 54 of the control lever 50 and the second through hole 43 of the second shaft 40 and connected to the read head 84.

Figure 4:
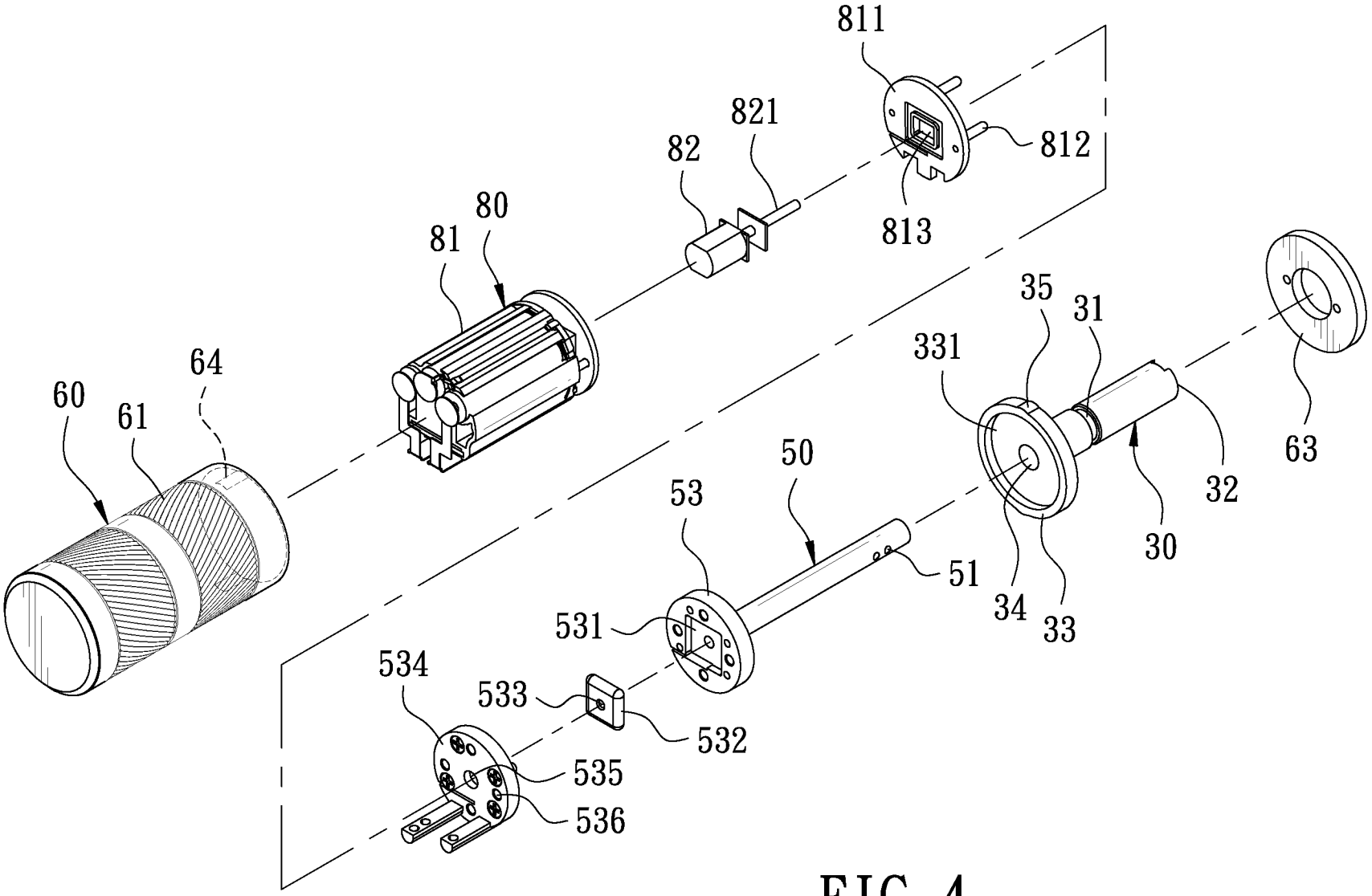
FIG. 4 is an exploded view of the first knob according to the preferred embodiment of the present invention.

FIG. 4 is an exploded view of the first knob according to the preferred embodiment of the present invention. As shown in FIG. 4, at least one first engaging block 35 is protruded from the outer periphery of the first coupling portion 33. The inner wall of the first accommodating space 62 of the first knob 60 is formed with at least one first engaging groove 64 corresponding to the first engaging block 35. The first engaging block 35 is engaged in the first engaging groove 64, so that the first knob 60 can drive the first shaft 30 to rotate. Furthermore, as shown in FIG. 4, the driving portion 53 of the control lever 50 has a recess 531. A screwing member 532 is provided in the recess 531. The screwing member 532 has a screw hole 533. The recess 531 is covered with a lid 534. The lid 534 has a driving hole 535 corresponding to the screw hole 533. The driving source 82 is provided with a screw 821. The screw 821 is inserted through the driving hole 535 and screwed to the screw hole 533, so that the driving source 82 is connected to the driving portion 53. The driving portion 53 is formed with at least one guide hole 536. The driving base 81 has a guide seat 811. The guide seat 811 is provided with at least one guide post 812 corresponding to the guide hole 536. The guide post 812 passes through the guide hole 536 and abuts against the inner wall of the rotation trough 331, so that the control lever 50 is restricted by the guide post 812 and can only slide axially relative to the first shaft 30. The guide seat 811 is formed with a through hole 813 corresponding to the driving hole 535 for the screw 821 to pass through.

Figure 5:
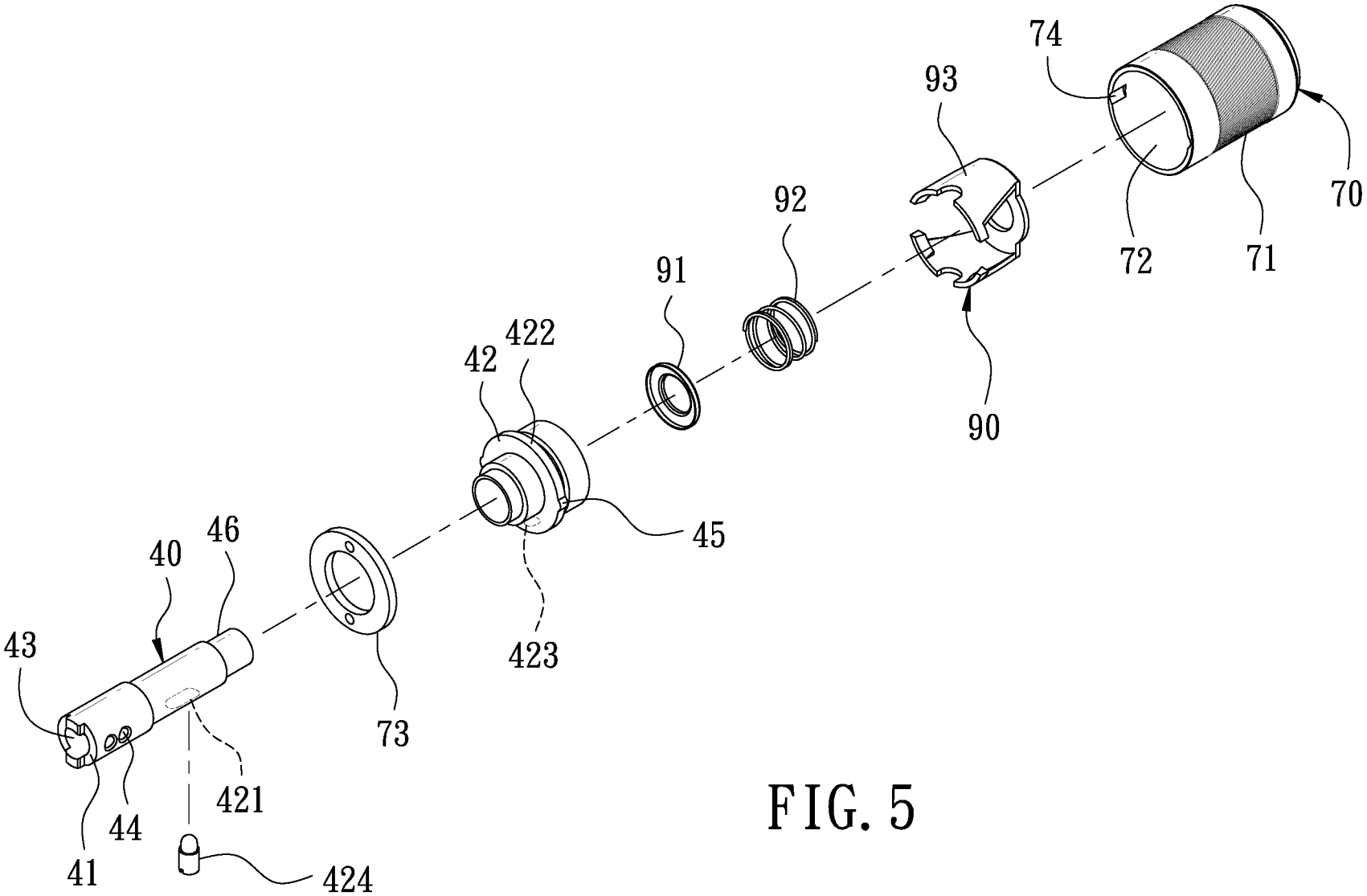
FIG. 5 is an exploded view of the second knob according to the preferred embodiment of the present invention.

FIG. 5 is an exploded view of the second knob according to the preferred embodiment of the present invention. As shown in FIG. 5, at least one second engaging block 45 is protruded from the outer periphery of the second coupling portion 42. The inner wall of the second accommodating space 72 of the second knob 70 is formed with at least one second engaging groove 74 corresponding to the second engaging block 45. The second engaging block 45 is engaged in the second engaging groove 74, so that the second knob 70 can drive the second shaft 40 to rotate. Furthermore, as shown in FIG. 5, the second coupling portion 42 has an elongated hole 421 disposed on the second shaft 40 and an annular seat 422 fitted onto the outer side wall of the second shaft 40. The annular seat 422 has a coupling hole 423 corresponding to the elongated hole 421. A coupling pin 424 is provided in the coupling hole 423. One end of the coupling pin 424 is inserted into the elongated hole 421, so that the annular seat 422 is connected to the second shaft 40. Furthermore, the second shaft 40 passes through the annular seat 422 and has a shoulder 46. The second shaft 40 further includes an anti-jam unit 90. The anti-jam unit 90 has a washer 91, a spring 92 and a bracket 93 that are sleeved on the shoulder 46 in sequence. The bracket 93 is connected to the annular seat 422, so that the second shaft 40 has a tendency to move toward the first shaft 30.

Figure 6:
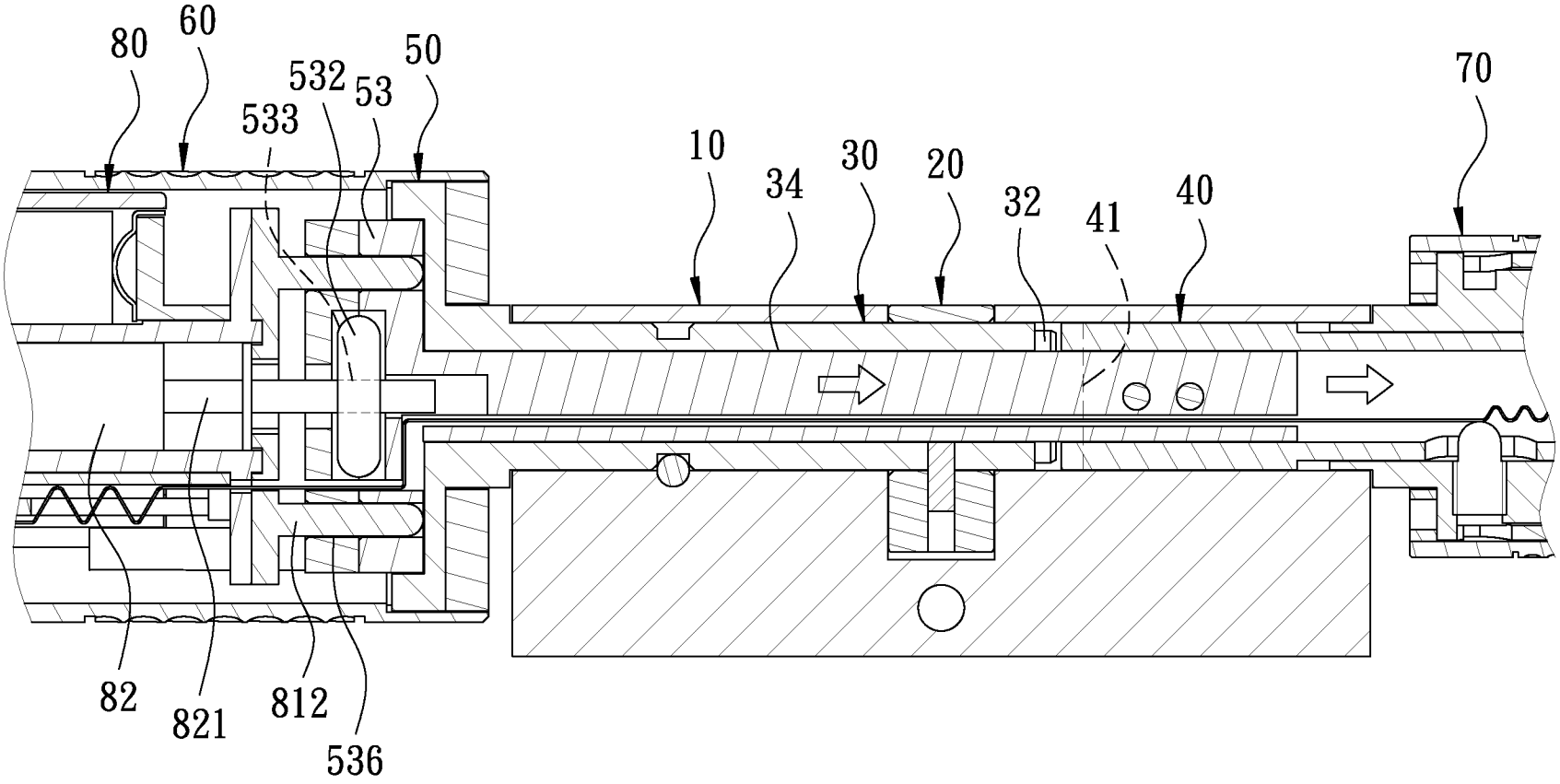
FIG. 6 is a schematic view according to the preferred embodiment of the present invention in a locked state.

FIG. 6 is a schematic view according to the preferred embodiment of the present invention in a locked state. The control unit 80 has a locked state and an unlocked state. In the locked state, the driving source 82 drives the screw 821 to start rotating, so that the screw 821 screws the screwing member 532, and the control lever 50 is moved toward the second knob 70 to push the second shaft 40 away from the first shaft 30, so that the second engaging portion 41 is disengaged from the first engaging portion 32. Therefore, when the user rotates the second knob 70, the second shaft 40 will link the control lever 50 and the driving base 81 to be idling, so that the second knob 70 cannot link the rotary cam 20 to perform unlocking.

Figure 7:
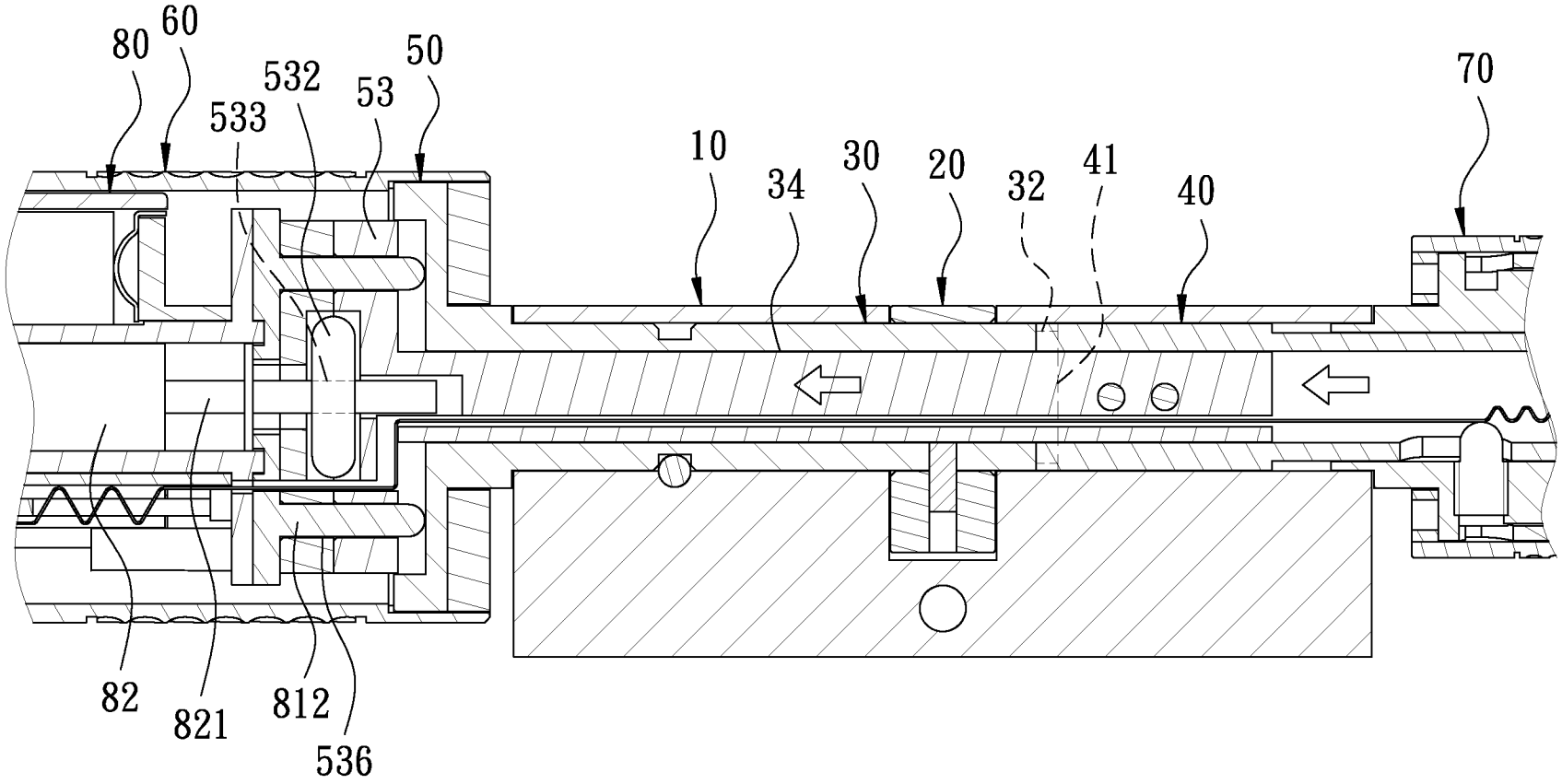
FIG. 7 is a schematic view according to the preferred embodiment of the present invention in an unlocked state.

FIG. 7 is a schematic view according to the preferred embodiment of the present invention in an unlocked state. When the control unit 80 is in the unlocked state, the driving source 82 drives the screw 821 to rotate in the reverse direction, and the screw 821 screws the screwing member 532, and the control lever 50 is moved toward the first knob 60 to pull the second shaft 40 to approach the first shaft 30, and then the second engaging portion 41 is engaged with the first engaging portion 32. Therefore, when the user rotates the second knob 70, the second shaft 40 will link the first shaft 30, and the first shaft 30 will further rotate the rotary cam 20 to achieve the purpose of unlocking.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An electronic cylinder lock, comprising:

a main body, having a first side, a second side opposite to the first side, and a circumferential side connected between the first side and the second side, the main body further having a shaft hole passing through the first side and the second side, the first side being formed with a corresponding first opening, the second side being formed with a corresponding second opening, the circumferential side of the main body being formed with a notch communicating with the shaft hole;

a rotary cam, accommodated in the notch, the rotary cam having a connecting hole corresponding to the shaft hole;

a first shaft, inserted in the shaft hole from the first opening, the first shaft being rotatable relative to the shaft hole, one end of the first shaft being inserted into the shaft hole and the connecting hole of the rotary cam and being provided with a first engaging portion, the first shaft being connected to the connecting hole so that the first shaft can drive the rotary cam to rotate, another end of the first shaft being provided with a first coupling portion, the first shaft having an axial first through hole therein, the first through hole passing through the first engaging portion and the first coupling portion;

a second shaft, inserted in the shaft hole from the second opening, the second shaft being rotatable and slidable axially relative to the shaft hole, one end of the second shaft, inserted into the shaft hole, being provided with a second engaging portion corresponding to the first engaging portion, the second engaging portion being engagable with the first engaging portion so that the second shaft can drive the first shaft to rotate, another end of the first shaft being provided with a second coupling portion;

a control lever, inserted in the first through hole of the first shaft, the control lever being slidable axially relative to the first shaft, one end of the control lever being inserted through the first engaging portion and connected to the second shaft so that the control lever can drive the second shaft to slide axially relative to the shaft hole, another end of the control lever being provided with a driving portion;

a first knob, connected to the first coupling portion and configured to drive the first shaft to rotate relative to the shaft hole, the first knob having a first accommodating space therein;

a second knob, connected to the second coupling portion and configured to drive the second shaft to rotate relative to the shaft hole;

a control unit, having a driving source accommodated in the first accommodating space, the driving source being connected to the driving portion of the control lever for driving the control lever to slide axially relative to the first shaft, wherein the control unit has a locked state and an unlocked state, when in the locked state, the driving source drives the control lever to push the second shaft away from the first shaft so that the second engaging portion is disengaged from the first engaging portion; when in the unlocked state, the driving source drives the control lever to pull the second shaft to approach the first shaft so that the second engaging portion is engaged with the first engaging portion.

2. The electronic cylinder lock as claimed in claim 1, wherein the first engaging portion is composed of a plurality of spaced protrusions, and the second engaging portion is composed of a plurality of spaced notches.

3. The electronic cylinder lock as claimed in claim 1, wherein the second shaft has an axial second through hole therein, the second through hole passes through the second engaging portion and the second coupling portion, an outer wall of the second shaft is formed with at least one first perforation communicating with the second through hole, the end of the control lever, inserted into the second through hole, is formed with at least one second perforation corresponding to the first perforation and is provided with at least one connecting pin, and the connecting pin is inserted through the corresponding first perforation and the corresponding second perforation so that the control lever is connected to the second shaft.

4. The electronic cylinder lock as claimed in claim 1, wherein the second coupling portion has an elongated hole disposed on the second shaft and an annular seat fitted onto an outer side wall of the second shaft, the annular seat has a coupling hole corresponding to the elongated hole, a coupling pin is provided in the coupling hole, and one end of the coupling pin is inserted into the elongated hole so that the annular seat is connected to the second shaft.

5. The electronic cylinder lock as claimed in claim 4, wherein the second shaft passes through the annular seat and has a shoulder, the second shaft further includes an anti-jam unit, the anti-jam unit has a washer, a spring and a bracket that are sleeved on the shoulder in sequence, and the bracket is connected to the annular seat.

6. The electronic cylinder lock as claimed in claim 1, wherein at least one first engaging block is protruded from an outer periphery of the first coupling portion, the first knob has a first housing disposed on an outside of the first coupling portion, an inner wall of the first housing is formed with at least one first engaging groove corresponding to the first engaging block, and the first engaging block is engaged in the first engaging groove so that the first housing is connected to the first coupling portion.

7. The electronic cylinder lock as claimed in claim 1, wherein at least one second engaging block is protruded from an outer periphery of the second coupling portion, the second knob has a second housing disposed on an outside of the second coupling portion, an inner wall of the second housing is formed with at least one second engaging groove corresponding to the second engaging block, and the second engaging block is engaged in the second engaging groove so that the second housing is connected to the second coupling portion.

8. The electronic cylinder lock as claimed in claim 1, wherein the driving portion of the control lever has a recess, a screwing member is provided in the recess, the screwing member has a screw hole, the recess is covered with a lid, the lid has a driving hole corresponding to the screw hole, the driving source is provided with a screw, and the screw is inserted through the driving hole and screwed to the screw hole.

9. The electronic cylinder lock as claimed in claim 1, wherein the driving portion is formed with at least one guide hole, the control unit has a driving base, the driving base has at least one guide post corresponding to the guide hole, and the guide post is slidably disposed in the guide hole.

10. The electronic cylinder lock as claimed in claim 1, wherein an outer wall of the control lever is formed with an axial slot, the second knob has a second accommodating space therein, the control unit further has a control assembly disposed in the first accommodating space, a read head disposed in the second accommodating space, and at least one lead wire, one end of the lead wire is connected to the control assembly, and another end of the lead wire is inserted through the slot of the control lever and the second through hole of the second shaft and connected to the read head.

* * * * *